US009530553B1

(12) United States Patent
Singh et al.

(10) Patent No.: US 9,530,553 B1
(45) Date of Patent: Dec. 27, 2016

(54) HIGH PERFORMANCE INDUCTOR/TRANSFORMER AND METHODS OF MAKING SUCH INDUCTOR/TRANSFORMER STRUCTURES

(71) Applicant: GLOBALFOUNDRIES Inc., Grand Cayman (KY)

(72) Inventors: Sunil Singh, Mechanicville, NY (US); Jagar Singh, Clifton Park, NY (US); Pankaj Marria, Clifton Park, NY (US)

(73) Assignee: GLOBALFOUNDRIES Inc., Grand Cayman (KY)

( * ) Notice: Subject to any disclaimer, the term of this patent is extended or adjusted under 35 U.S.C. 154(b) by 0 days.

(21) Appl. No.: 14/929,869

(22) Filed: Nov. 2, 2015

(51) Int. Cl.

| | |
|---|---|
| ***H01F 5/00*** | (2006.01) |
| ***H01F 27/24*** | (2006.01) |
| ***H01F 17/04*** | (2006.01) |
| ***H01F 27/28*** | (2006.01) |

(52) U.S. Cl.
CPC ..... *H01F 27/24* (2013.01)

(58) Field of Classification Search
CPC ..... H01F 27/24; H01F 27/255; H01F 3/08; H01F 2003/106; H01F 5/003; H01F 17/0006; H01F 17/06; H01F 17/062; H01F 2017/048
USPC 336/212, 233, 223, 200, 221, 229; 257/531, 277
See application file for complete search history.

(56) References Cited

U.S. PATENT DOCUMENTS

| | | | | |
|---|---|---|---|---|
| 9,048,021 | B2 * | 6/2015 | Duplessis | H01F 17/0006 |
| 2009/0309687 | A1 * | 12/2009 | Aleksov | H01F 17/0033 336/200 |
| 2010/0254168 | A1 * | 10/2010 | Chandrasekaran | H01F 3/10 363/37 |
| 2010/0259350 | A1 * | 10/2010 | Biar | H01F 17/0033 336/200 |

* cited by examiner

*Primary Examiner* — Mangtin Lian
(74) *Attorney, Agent, or Firm* — Amerson Law Firm, PLLC

(57) ABSTRACT

An inductor/transformer device is disclosed including a lower inductor/transformer structure including a first inner core material and a first outer cap layer, an upper inductor/transformer structure positioned above and vertically spaced apart from the lower inductor/transformer structure, the upper inductor/transformer structure including a second inner core material and a second outer cap layer, wherein the lower surface area of the upper inductor/transformer structure is different than the upper surface area of the lower inductor/transformer structure, and an insulating material positioned between the upper surface of the lower inductor/transformer structure and the lower surface of the upper inductor/transformer structure.

22 Claims, 14 Drawing Sheets

HIGH PERFORMANCE INDUCTOR/TRANSFORMER AND METHODS OF MAKING SUCH INDUCTOR/TRANSFORMER STRUCTURES

BACKGROUND OF THE INVENTION

1. Field of the Invention

Generally, the present disclosure relates to the manufacture of semiconductor devices, and, more specifically, to unique high performance inductor/transformer structures and methods of making such inductor/transformer structures.

2. Description of the Related Art

The fabrication of advanced integrated circuits, such as CPUs, storage devices, ASICs (application specific integrated circuits) and the like, requires a large number of circuit elements, such as transistors, capacitors, resistors, etc., to be formed on a given chip area according to a specified circuit layout. Passive elements are very important components of many integrated circuit products. Passive elements can be simplistically separated into distributed elements and lumped elements. Examples of distributed passive elements include transmission lines, waveguides, antennas, etc. Examples of lumped passive elements include inductors, transformers, linear and variable capacitors, resistors, etc. Passive elements are indispensable in analog and RF systems. Such passive elements may be used in numerous ways, e.g., in matching networks, LC tank circuits, attenuators, filters, decoupling capacitors, loads, or die antennas and antenna reflectors, etc.

An inductor is one of the most critical elements in RF and microwave circuits for high frequency wireless applications. If the inductance of the inductor is too low, the lumped circuit will not reach the desired performance targets. Spiral inductors that have a high inductance value are commonly in demand for wireless system-on-chip (SoC) and radio frequency integrated circuits (RFIC).

Existing inductor structures are typically manufactured in one of the upper metallization layers of an integrated circuit product. In one example, an inductor may comprise a plurality of laterally spaced apart solid metal structures, e.g., copper, that are positioned in a layer of insulating material. Such a side-by-side configuration of the components of the inductor means that the inductor consumes a significant amount of plot space. Moreover, using such prior art inductor designs, achieving sufficient levels of inductance could sometimes be problematic.

The present disclosure is directed to unique high performance inductor/transformer structures and methods of making such inductor/transformer structures that may reduce or solve one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the present disclosure is directed to unique high performance inductor/transformer structures and methods of making such inductor/transformer structures. One illustrative inductor/transformer device disclosed herein includes, among other things, a lower inductor/transformer structure comprising a first inner core material and a first outer cap layer, the first outer cap layer defining an upper surface area of the lower inductor/transformer structure, an upper inductor/transformer structure positioned above and vertically spaced apart from the lower inductor/transformer structure, the upper inductor/transformer structure comprising a second inner core material and a second outer cap layer, the second outer cap layer defining a lower surface area of the upper inductor/transformer structure, wherein the lower surface area of the upper inductor/transformer structure is different than the upper surface area of the lower inductor/transformer structure, and an insulating material positioned above an upper surface of the substrate and between the upper surface of the lower inductor/transformer structure and the lower surface of the upper inductor/transformer structure.

BRIEF DESCRIPTION OF THE DRAWINGS

The disclosure may be understood by reference to the following description taken in conjunction with the accompanying drawings, in which like reference numerals identify like elements, and in which.

Figure 1A:
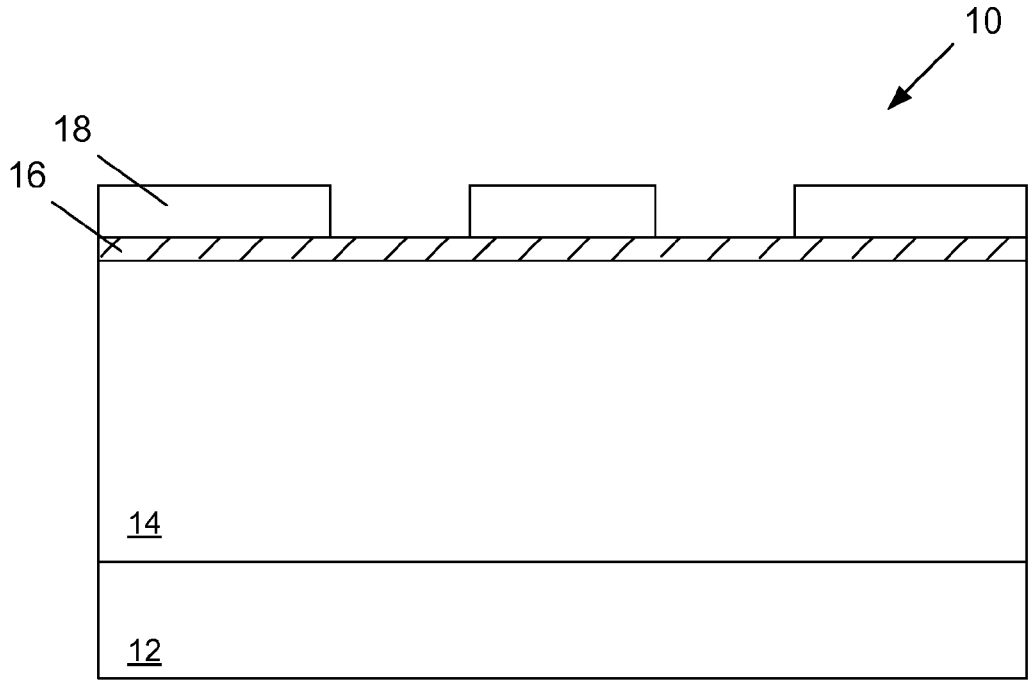
FIGS. 1A-1L depict one illustrative method disclosed herein of forming a unique high performance inductor/transformer.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The present disclosure is directed to various methods of forming unique high performance inductor/transformer structures and methods of making such inductor/transformer structures. As will be readily apparent to those skilled in the art upon a complete reading of the present application, the methods disclosed herein may be employed when forming inductors/transformers in a variety of different integrated circuit products, including, but not limited to, RFIC products, system-on-chip (SoC) products, microwave circuits, attenuators, filters, antennas, ASIC's, logic devices, memory devices, etc. With reference to the attached drawings, various illustrative embodiments of the novel methods and the novel inductors/transformers disclosed herein will now be described in more detail.

FIGS. 1A-1L depict one illustrative method disclosed herein of forming a unique high performance inductor/transformer structure. FIG. 1A is a simplified view of an illustrative integrated circuit (IC) product 10 that is formed above a semiconductor substrate 12. The substrate 12 may have a variety of configurations, such as a bulk substrate configuration, an SOI (silicon-on-insulator) configuration, and it may be made of materials other than silicon. Thus, the terms "substrate" or "semiconductor substrate" should be understood to cover all semiconducting materials and all forms of such materials. The IC product 10 may be any type of integrated circuit product that employs inductors/transformers. The layers of material depicted herein may be formed by performing a variety of known processing techniques, such as a chemical vapor deposition (CVD) process, an atomic layer deposition (ALD) process, a physical vapor deposition (PVD) process, or plasma enhanced versions of such processes, electroplating, etc.

FIG. 1A depicts the IC product 10 at a point in fabrication wherein the individual semiconductor circuit devices (not shown), e.g., transistor devices, memory devices, circuits, etc., have been formed in the substrate 12, various device-level conductive contacts (not shown) have been formed to establish electrical contact to those semiconductor devices and one or more so-called metallization layers, e.g., M1 (metal 1) and above, have been formed above the substrate 12. Also depicted in FIG. 1A are a layer of insulating material 14, e.g., silicon dioxide, a hard mask layer 16, e.g., silicon nitride, and a patterned photoresist mask 18. The layer of insulating material 14 is part of an illustrative metallization layer that may be formed at any level above the substrate 12, e.g., level 3, 6, 7, etc. As noted above, in one example, the layer of insulating material 14 may be a layer of silicon dioxide or a layer of a so-called low-k (k value less than about 3.3) insulating material, and it may be formed to any desired thickness depending upon the particular application. The hard mask layer 16 may be formed to any desired thickness.

Figure 1B:
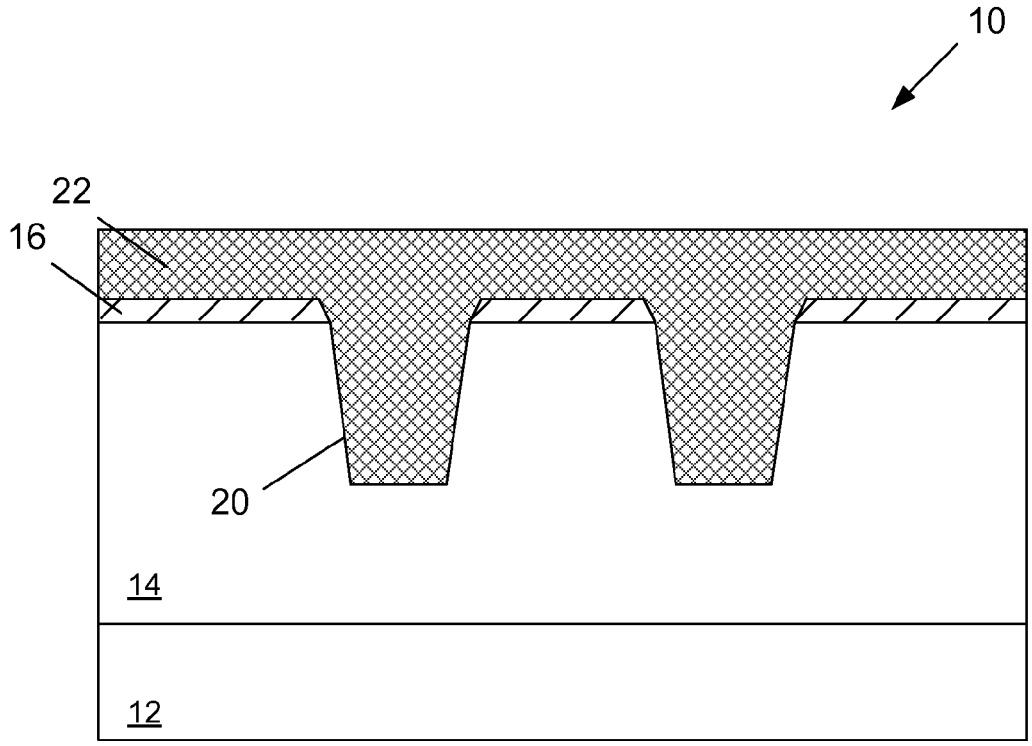

FIG. 1B depicts the product 10 after several process operations were performed. First, the hard mask layer 16 was patterned by performing an etching process through the patterned photoresist mask 18. Thereafter, the patterned photoresist mask 18 was removed, e.g., by ashing. Next, using the patterned hard mask layer 16 as an etch mask, an etching process was performed to define a plurality of trenches 20. The width and depth of the trenches 20 may vary depending upon the particular application. The trenches 20 may be essentially linear and extend into and out of the drawing page for any desired distance. In other applications, when viewed from above (plan view), the trenches 20 may define an overall non-linear configuration, e.g., semi-circular, rectangular, etc. After the trenches 20 were formed, a magnetic core material 22 was deposited so as to over-fill the trenches 20. The magnetic core material 22 may be comprised of a variety of different materials, e.g., an iron (Fe) containing material such as NiFe, CoFe, $Fe_3O_4$, $Fe_3Al_2Si_3O_{12}$, or other non-iron containing magnetic materials such as $Mn_3Al_2Si_3O_{12}$, $Ca_3Cr_2Si_3O_{12}$, $Ca_3Al_2Si_3O_{12}$, $Mg_3Al_2Si_3O_{12}$, etc.

Figure 1C:
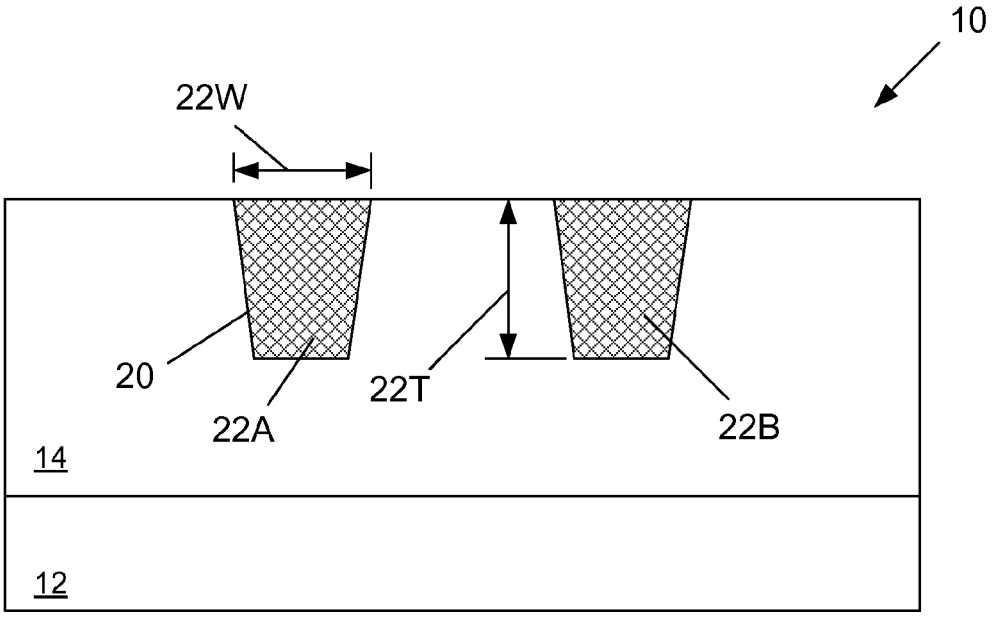

FIG. 1C depicts the product 10 after one or more planarization processes, e.g., chemical mechanical polishing (CMP) processes, were performed to remove the excess portions of the magnetic core material 22 and the patterned hard mask layer 16. These process operations result in the definition of lower magnetic core regions 22A-B. Of course, any desired number of the magnetic core regions, e.g., one or more, may be formed on a particular product 10. The width 22W and depth or thickness 22T of the magnetic core regions 22A-B may vary depending on the particular application. In one illustrative embodiment, the width 22W may fall within the range of about 350-500 nm, while the thickness 22T may fall within the range of about 750-2000 nm. The lateral spacing between the magnetic core regions 22A-B (where multiple magnetic cores are present) may also vary depending upon the particular application.

Figure 1D:
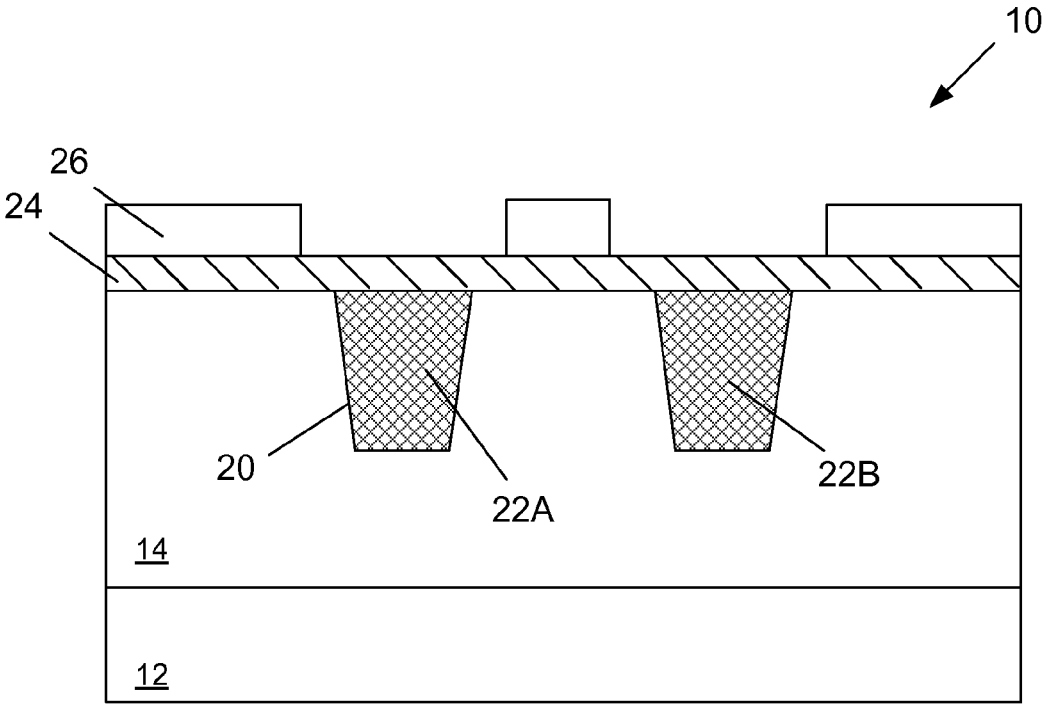

FIG. 1D depicts the product 10 after several process operations were performed.

First, a hard mask layer 24, e.g., silicon nitride was formed above the layer of insulating material 14 and the magnetic core regions 22A-B. Thereafter, a patterned photoresist mask 26 was formed above the hard mask layer 24.

Figure 1E:
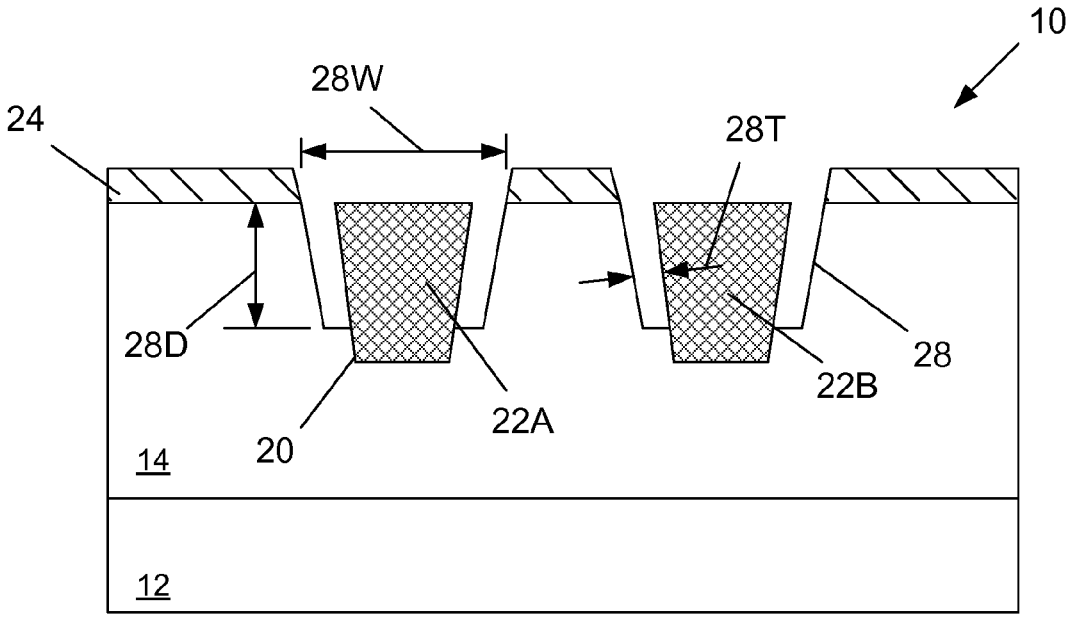

FIG. 1E depicts the product 10 after several process operations were performed. First, the hard mask layer 24 was patterned by performing an etching process through the patterned photoresist mask 26. Thereafter, the patterned photoresist mask 26 was removed, e.g., by ashing. Next, using the patterned hard mask layer 24 as an etch mask, an etching process was performed to define a plurality of trenches 28 in the layer of insulating material 14 adjacent the magnetic core regions 22A-B. The width 28W, normal thickness 28T and depth 28D of the trenches 28 may vary depending upon the particular application. In one illustrative embodiment, the width 28W may fall within the range of about 750-900 nm, the normal thickness 28T may be about 200 nm, while the depth 28D may be as much as about three-fourths of the thickness 22T (FIG. 1C) of the magnetic core regions 22A-B.

Figure 1F:
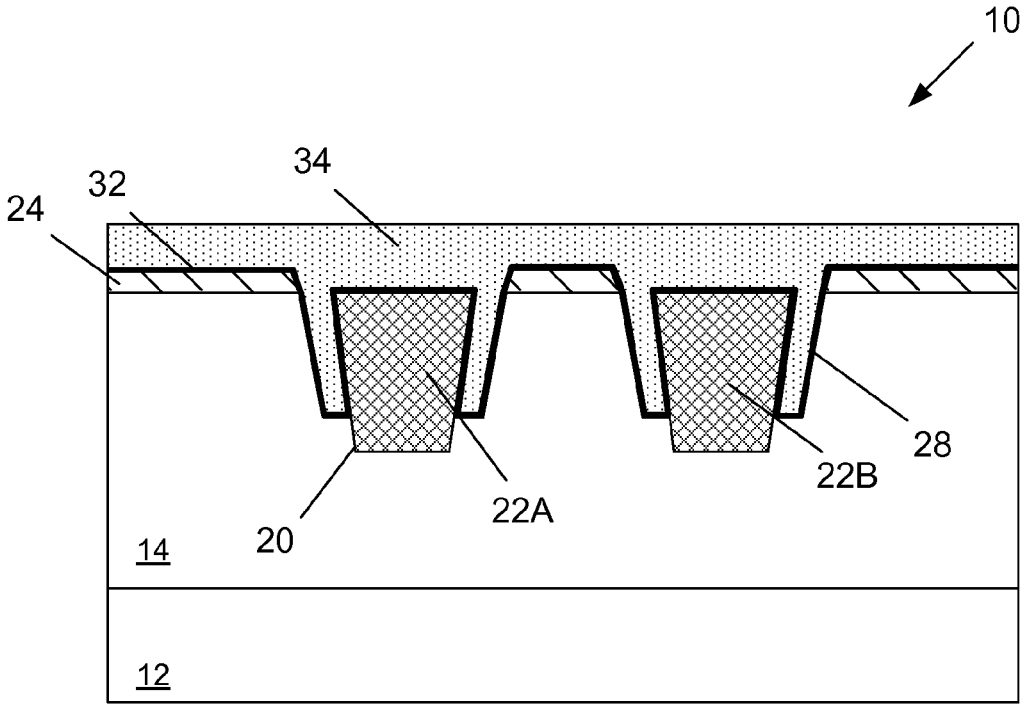

FIG. 1F depicts the product 10 after several process operations were performed. First, one or more barrier layers 32 (schematically depicted by a single line) were deposited on the product 10, in the trenches 28 and on the magnetic core regions 22A-B. The barrier layer 32 is intended to be representative of any type of barrier material (or combination of barrier materials) that are commonly employed on integrated circuit products, e.g., tantalum, tantalum nitride, titanium, titanium nitride, etc. The barrier layer(s) 32 may be formed by performing one or more conformal PVD deposition processes. Next, a layer of conductive metal material 34 was deposited so as to overfill the trenches 28. The conductive metal material 34 may be comprised of a variety of different metals or metal compounds, e.g., copper, Al, Au, Ag, etc.

Figure 1G:
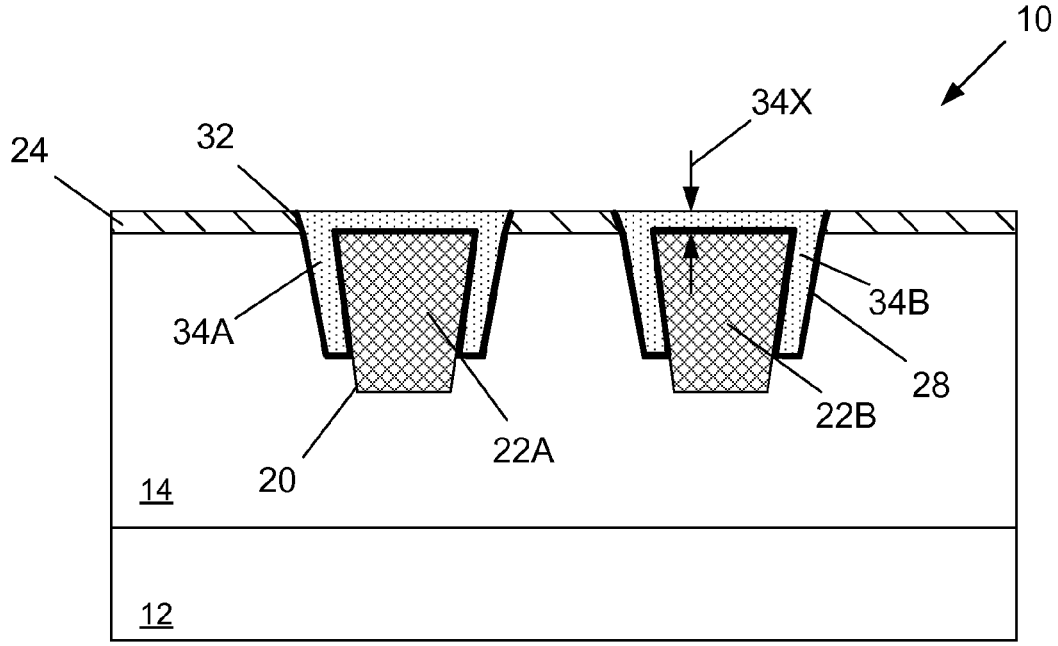

FIG. 1G depicts the product 10 after one or more planarization processes, e.g., chemical mechanical polishing (CMP) processes, were performed to remove the excess portions of the conductive metal material 34. This process operation results in the definition of lower metal cap layers 34A-B that are positioned around portions of the lower magnetic core regions 22A-B. The metal cap layers 34A-B have a thickness 34X that can vary depending upon the application, e.g., in one example, the thickness 34X may fall within the range of about 200 nm. As used herein and in the claims, the term "cap layer" shall be understood to include the conductive metal material 34 and the barrier layer(s) 32 (if present).

Figure 1H:
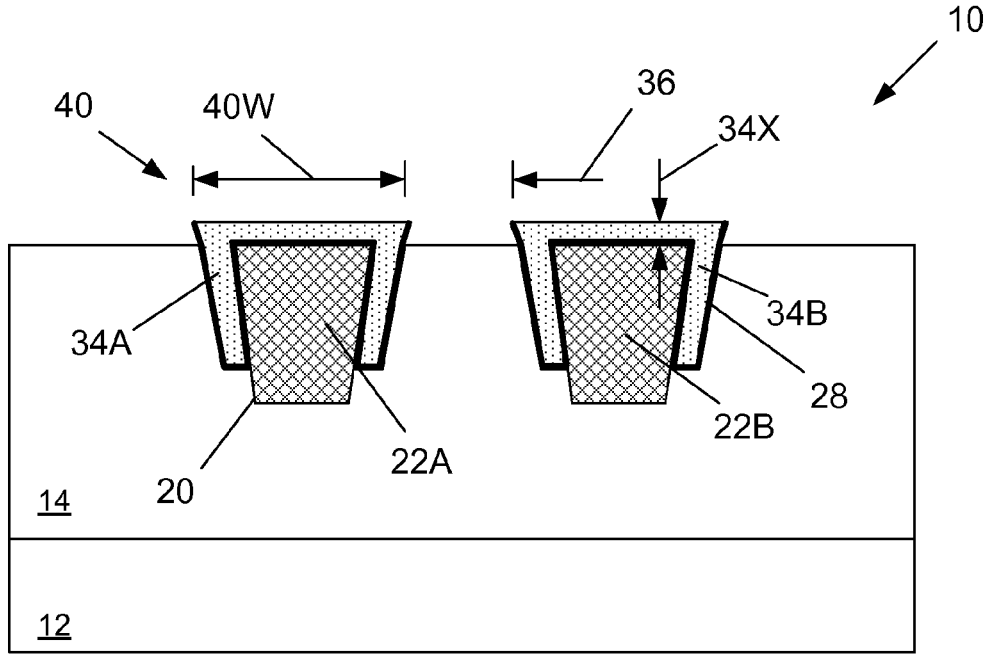

FIG. 1H depicts the product 10 after an etching process was performed to remove the patterned hard mask layer 24 relative to the surrounding structures and materials. This process completes the formation of a plurality of lower inductor/transformer structures 40, each of which is comprised of one of the magnetic core regions 22A-B and one of the metal cap layers 34A-B. The overall upper lateral width 40W of each of the lower inductor/transformer structures 40, as well as the lateral spacing 36 between the inductor/transformer structures 40 (when multiple structures 40 are present) may vary depending upon the application. In one illustrative embodiment, the upper lateral width 40W may fall within the range of about 750-900 nm, while the lateral spacing 36 may be about 150 nm.

Figure 1I:
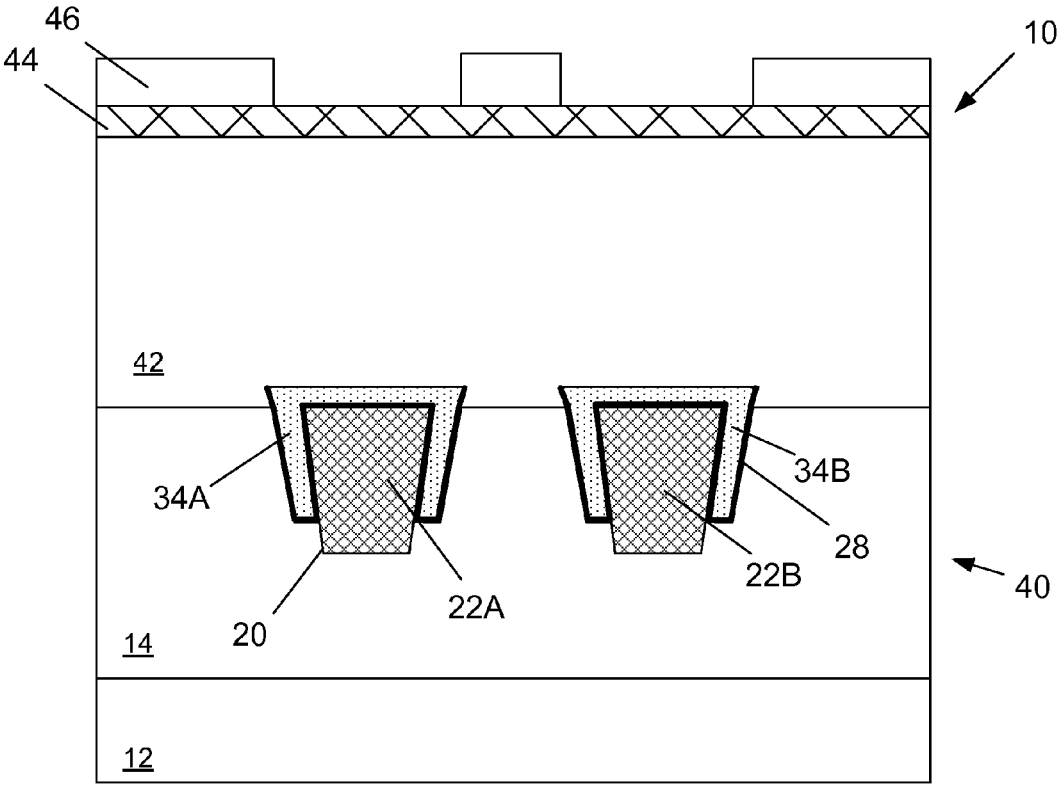

FIG. 1I depicts the product 10 after several process operations were performed. First, another layer of insulating material 42, e.g., silicon dioxide, another hard mask layer 44, e.g., silicon nitride and another patterned photoresist mask 46 was formed above the lower inductor/transformer structures 40. The layers of insulating material 14, 42 may be made of the same material or they may be made of different materials.

Figure 1J:
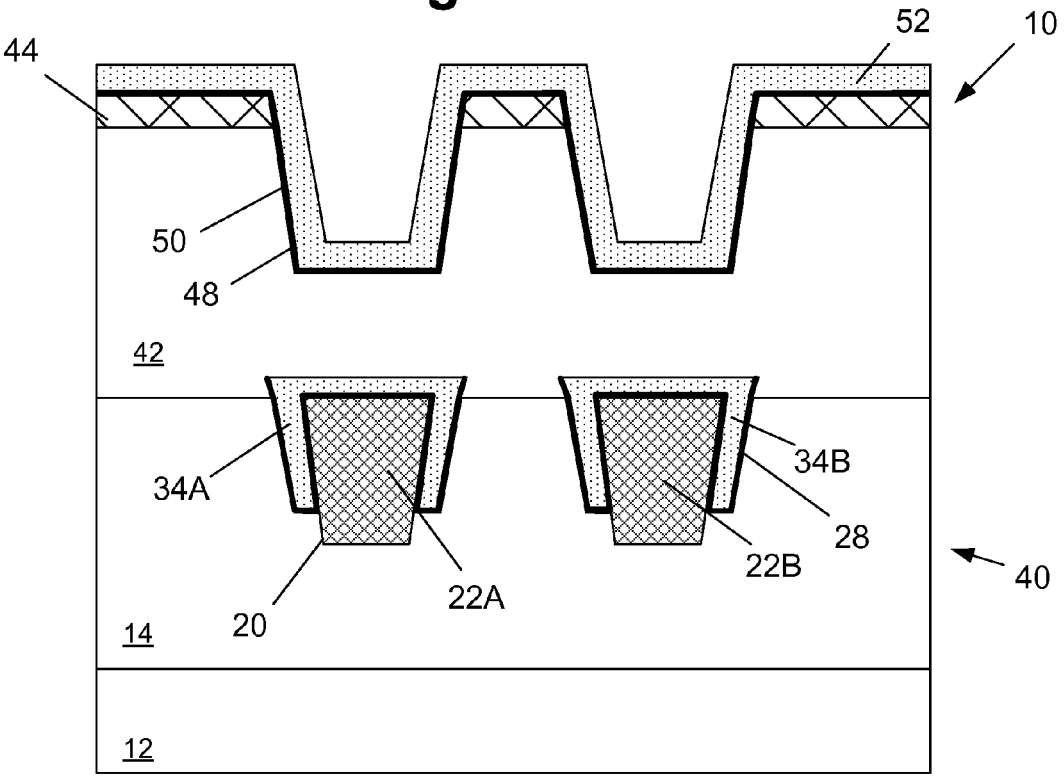

FIG. 1J depicts the product 10 after several process operations were performed. First, the hard mask layer 44 was patterned by performing an etching process through the patterned photoresist mask 46. Thereafter, the patterned photoresist mask 46 was removed, e.g., by ashing. Next, using the patterned hard mask layer 44 as an etch mask, an etching process was performed to define a plurality of trenches 48 in the layer of insulating material 42. The width and depth of the trenches 48 may vary depending upon the particular application. The trenches 48 are essentially formed above the lower inductor/transformer structures 40. Next, one or more barrier layers 50 (schematically depicted by a single line) were deposited on the product 10 and in the trenches 48. As with the previous barrier layer 32, the barrier layer 50 is intended to be representative of any type of barrier material (or combination of barrier materials) that are commonly employed on integrated circuit products, e.g., tantalum, tantalum nitride, titanium, titanium nitride, etc. The barrier layer(s) 50 may be formed by performing one or more conformal PVD deposition processes. The barrier layers 32, 50 may be comprised of the same or different materials. Next, a layer of conductive metal material 52 was deposited on the barrier layer 50 and in the trenches 48 by performing a conformal deposition process. The thickness of the conformal conductive metal material layer 52 may vary depending upon the particular application, e.g., 50-200 nm. The conductive metal material layer 52 may be comprised of a variety of different metals or metal compounds, and it may be comprised of any of the materials identified above for the conductive metal material 34. The conductive metal materials 34, 52 may be comprised of the same or different metal materials. In one illustrative example, the conductive metal materials 34, 52 are both comprised of copper.

Figure 1K:
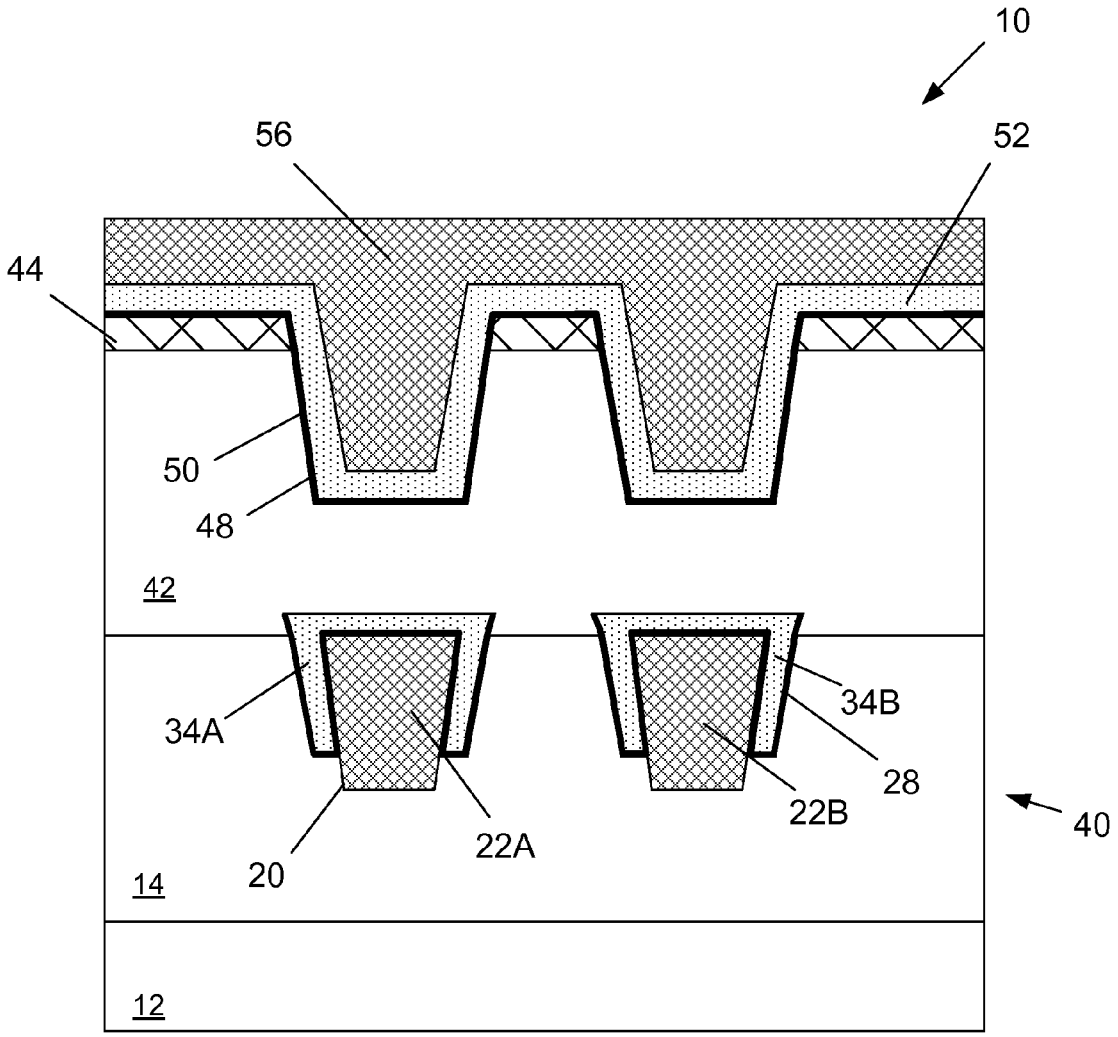

FIG. 1K depicts the product 10 after a magnetic core material 56 was deposited so as to over-fill the trenches 48. The magnetic core material 56 may be comprised of the same materials as identified above for the magnetic core material 22. The magnetic core materials 22, 56 may be comprised of the same or different materials.

Figure 1L:
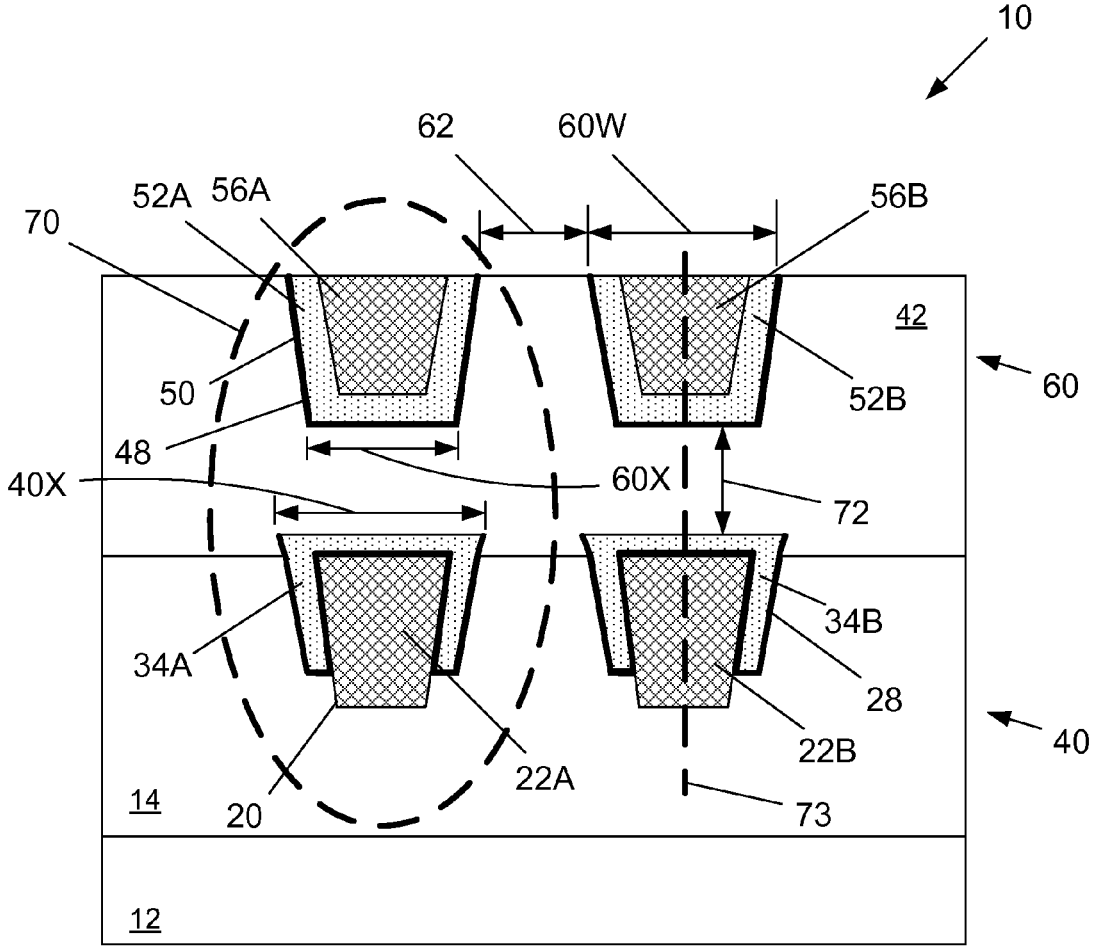

FIG. 1L depicts the product 10 after one or more planarization processes, e.g., chemical mechanical polishing (CMP) processes, were performed to remove the excess portions of the magnetic core material 56, the layer of conductive metal material 52, the barrier layer 50 and the patterned hard mask layer 44. These process operations result in the definition of a plurality of upper inductor/transformer structures 60, each of which is comprised of one of the magnetic core regions 56A-B and one of the metal cap layers 52A-B. As used herein and in the claims, the term "cap layer" shall be understood to include the conductive metal material 52 and the barrier layer(s) 50 (if present). The overall upper lateral width 60W of each of the upper inductor/transformer structures 60, as well as the lateral spacing 62 between the upper inductor/transformer structures 60 (when multiple structures 60 are present) may vary depending upon the application. In one illustrative embodiment, the upper lateral width 60W and the lateral spacing 62 may generally correspond to the upper lateral width 40W and lateral spacing 36 of the lower inductor/transformer structures 40, although that need not be the case in each application.

With continuing reference to FIG. 1L, a novel high performance inductor/transformer structure 70 (enclosed in a dashed line) is provided, which, in one embodiment, is comprised of one of the upper inductor/transformer structures 60 and one of the lower inductor/transformer structures 40. In other embodiments, the novel high performance inductor/transformer structure may include both of the upper inductor/transformer structures 60 and both of the lower inductor/transformer structures 40 shown in FIG. 1L so as to enhance performance. The metal cap layer 34A defines an upper surface of the lower inductor/transformer structure 40 that has a lateral width 40X. The metal cap layer 52A defines a lower surface of the upper inductor/transformer structure 60 that has a lateral width 60X. The vertical spacing 72 between the upper surface of the lower inductor/transformer structure 40 and the lower surface of the upper inductor/transformer structure 60 may vary depending upon the particular application, e.g., 350-800 nm. The lateral width 60X and the lateral width 40X and the surface areas associated with structures 60 and 40 may vary depending upon the particular application. In one illustrative example, the lateral width 60X may fall within the range of about 350-1000 nm, while the lateral width 40X may fall within the range of about 550-800 nm. In some cases the widths 60X and 40X and the surface areas of the upper and lower inductor/transformer structures 60, 40 may be the same. In other cases, the widths 60X and 40X and the surface areas of the upper and lower inductor/transformer structures 60, 40 may be different. In the depicted example, the lateral width 60X (and the lower surface area of the upper inductor/transformer structures 60) is less than the lateral width 40X (and the upper surface area of the lower inductor/transformer structures 40), although that may not be the case in all applications. For example, in some applications, the lateral width 60X (and the lower surface area of the upper inductor/transformer structures 60) may be greater than the lateral width 40X (and the upper surface area of the lower inductor/transformer structures 40). That is, the lower surface area of the upper inductor/transformer structures 60 and the upper surface area of the lower inductor/transformer structures 40 may be different from one another, i.e., one surface area may be larger or smaller than the other surface area, or they both may be about the same, depending upon the particular application.

As it relates to the performance of the inductor/transformer structure 70, the ratio between the lower surface area of the upper inductor/transformer structure 60 (having an illustrative lateral width 60X) and the upper surface area of the lower inductor/transformer structure 40 (having an illustrative lateral width 40X) can be selected so as to provide a high performance inductor with a high inductance and/or a high performance transformer so as to optimize the mutual conductance. In general, when an electrical field is applied to the device, the lower inductor/transformer structure 40 and the upper inductor/transformer structure 60 start mutual conductance. Of course, as will be recognized by those skilled in the art after a complete reading of this present application, the structure disclosed herein may be used as a transformer only if desired.

Additionally, the conductive metal cap layers 34A-B, 52A-B are more electrically conductive than the magnetic material core regions 22A-B, 56A-B. As a result of this unique structure, the outer, more conductive "skin" of the upper and lower inductor/transformer structures 60, 40 effectively reduces the "skin depth" for carriers during operation since the metal cap layers will provide less resistance than the magnetic material core regions.

Again referring to FIG. 1L, the "stacked" configuration of the novel high performance inductor/transformer structure 70, i.e., the positioning of the upper inductor/transformer structure 60 above the lower inductor/transformer structure 40 (with a vertical separation therebetween) and having the more conductive outer skins 52A, 34A facing one another is also unique relative to traditional inductors where corresponding structures are laterally spaced apart from one another and do not have more conductive outer surfaces. In general, as noted above, larger surface areas for opposing surfaces of the upper and lower inductor/transformer structures 60, 40 provide for a better Q factor, while the combination of lateral and vertical conductance will provide better performance. Of course, the centerlines of the upper and lower inductor/transformer structures 60, 40 need not be precisely aligned, as depicted by the dashed line 73, but that may be the case in some applications. That is, there may be some slight misalignment between the centerlines of the upper and lower inductor/transformer structures 60, 40, e.g., 5-15 nm, while still providing a unique high performance inductor/transformer structure 70. As a result of this stacked configuration, the inductor/transformer structure 70 consumes less area on the product relative to prior art designs and therefore is a more cost-effective solution.

FIG. 2A-2L depict another one illustrative method disclosed herein of forming a unique high performance inductor/transformer structure. Relative to the embodiment shown in FIGS. 1A-1L, in this embodiment, the magnetic core regions 56A-B, 22A-B are replaced with a metal material and the process flow is different.

Figure 2A:
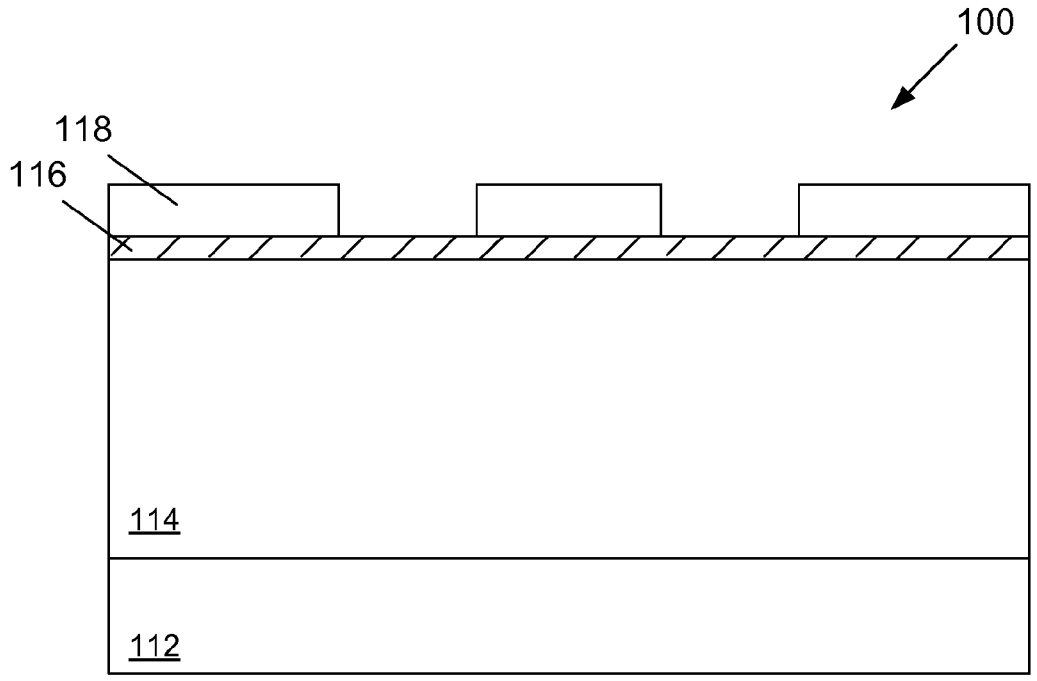
FIGS. 2A-2L depict another illustrative method disclosed herein of forming a unique high performance inductor/transformer.

FIG. 2A depicts an the IC product 100 at a point in fabrication wherein the individual semiconductor circuit devices (not shown), e.g., transistor devices, memory devices, circuits, etc., have been formed in the substrate 112, various device-level conductive contacts (not shown) have been formed to establish electrical contact to those semiconductor devices and one or more so-called metallization layers, e.g., Ml (metal 1) and above, have been formed above the substrate 112. Also depicted in FIG. 2A are a layer of insulating material 114, e.g., silicon dioxide, a hard mask layer 116, e.g., silicon nitride, and a patterned photoresist mask 118. The layer of insulating material 114 is part of an illustrative metallization layer that may be formed at any level above the substrate 112, e.g., level 3, 6, 7, etc. As noted above, in one example, the layer of insulating material 114 may be a layer of silicon dioxide or a layer of a so-called low-k (k value less than about 3.3) insulating material, and it may be formed to any desired thickness depending upon the particular application. The hard mask layer 116 may be formed to any desired thickness.

Figure 2B:
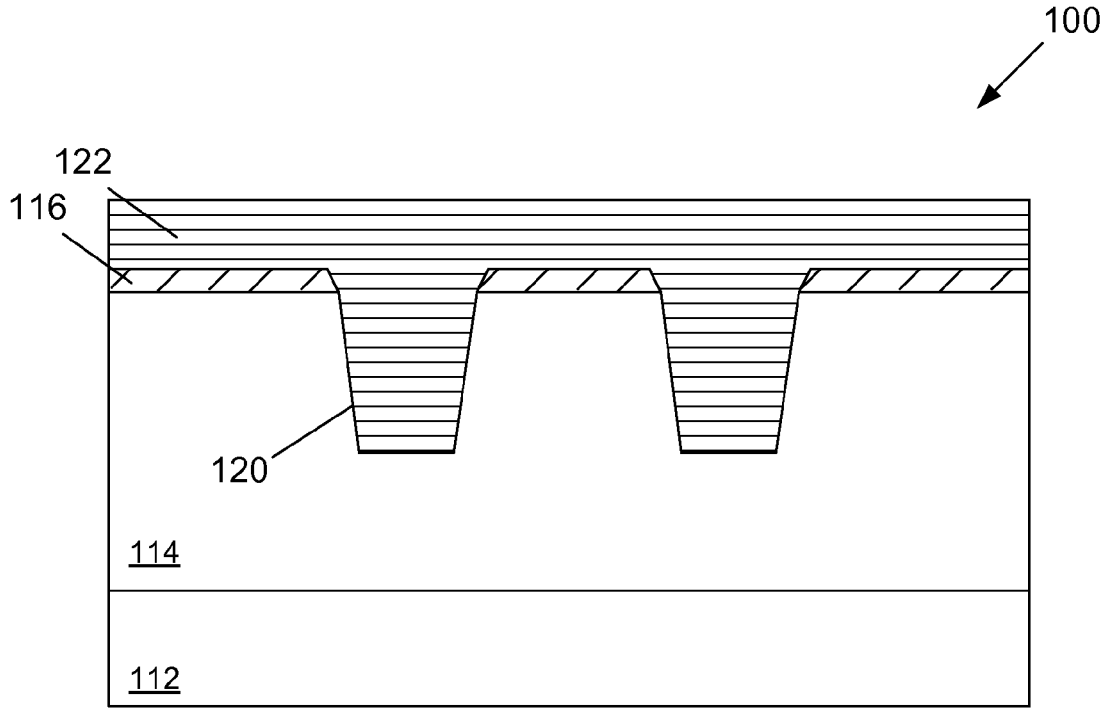

FIG. 2B depicts the product 100 after several process operations were performed. First, the hard mask layer 116 was patterned by performing an etching process through the patterned photoresist mask 118. Thereafter, the patterned photoresist mask 118 was removed, e.g., by ashing. Next, using the patterned hard mask layer 116 as an etch mask, an etching process was performed to define a plurality of trenches 120 in the layer of insulating material. The width and depth of the trenches 120 may vary depending upon the particular application and they may correspond to the dimensions/configurations identified above for the trenches 20. After the trenches 120 were formed, a metal-containing material 122 was deposited so as to over-fill the trenches 120. The metal-containing material 122 may be comprised of a variety of different materials, e.g., aluminum, Au, Al, etc.

Figure 2C:
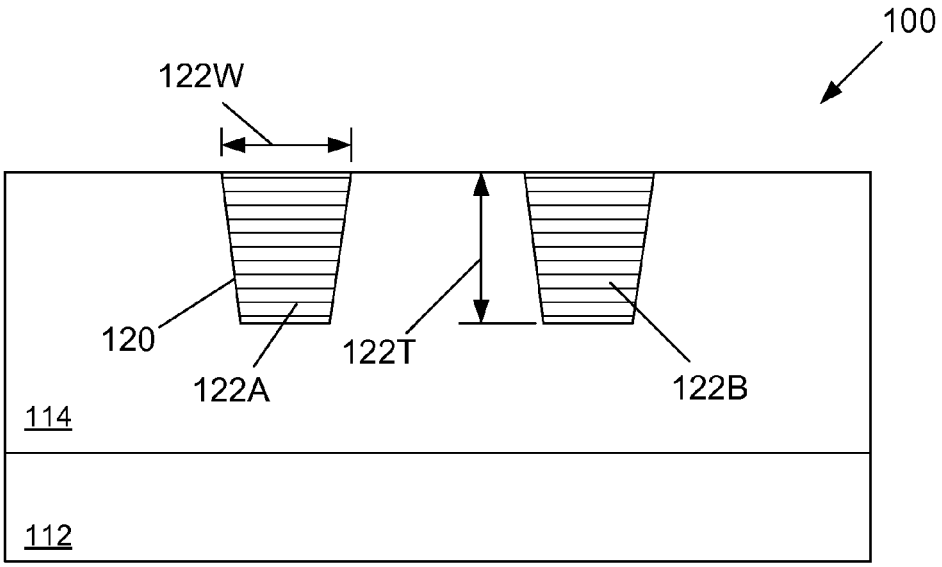

FIG. 2C depicts the product 100 after one or more planarization processes, e.g., chemical mechanical polishing (CMP) processes, were performed to remove the excess portions of the metal-containing material 122 and the patterned hard mask layer 116. These process operations result in the definition of lower metal core regions 122A-B. Of course, any desired number of the metal core regions 122A-B, e.g., one or more, may be formed on a particular product 100. The width 122W and depth or thickness 122T of the metal core regions 122A-B may vary depending on the particular application, and they may generally correspond to those given above for the magnetic core regions 22A-B.

Figure 2D:
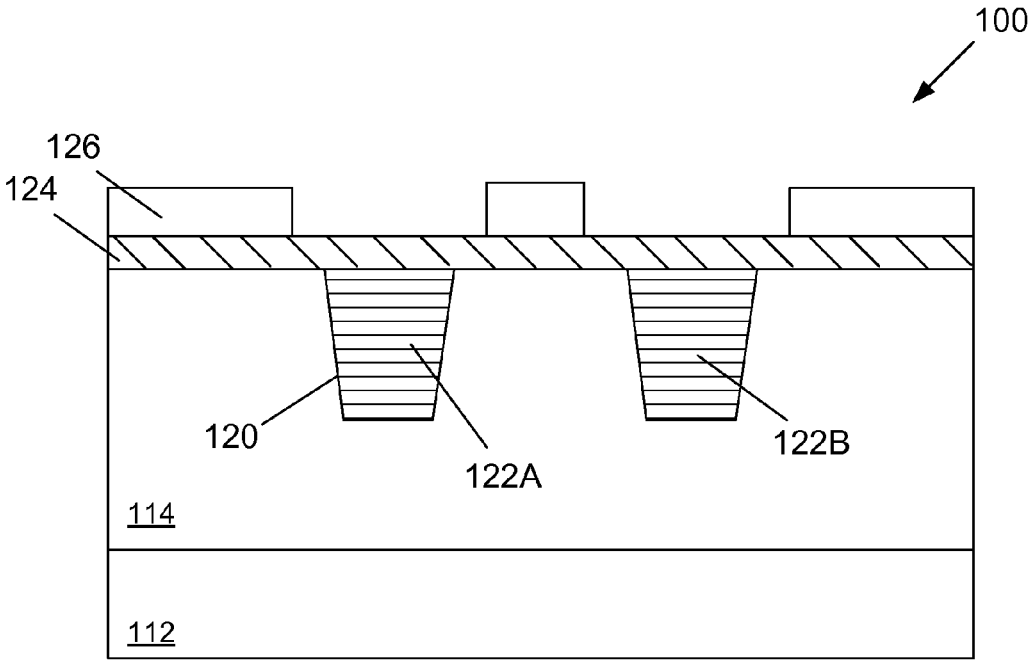

FIG. 2D depicts the product 100 after several process operations were performed. First, a hard mask layer 124, e.g., silicon nitride, was formed above the layer of insulating material 114 and the metal core regions 122A-B. Thereafter, a patterned photoresist mask 126 was formed above the hard mask layer 124.

Figure 2E:
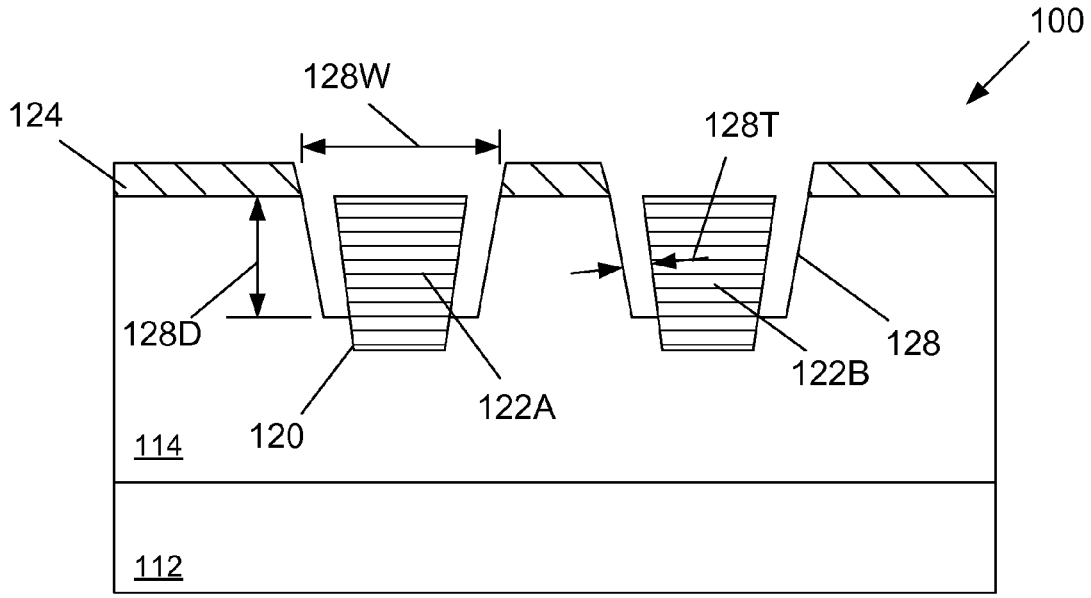

FIG. 2E depicts the product 100 after several process operations were performed. First, the hard mask layer 124 was patterned by performing an etching process through the patterned photoresist mask 126. Thereafter, the patterned photoresist mask 126 was removed, e.g., by ashing. Next, using the patterned hard mask layer 124 as an etch mask, an etching process was performed to define a plurality of trenches 128 in the layer of insulating material 114 adjacent the metal core regions 122A-B. The width 128W, normal thickness 128T and depth 128D of the trenches 128 may vary depending upon the particular application, and in one embodiment they may generally correspond to the dimensions of the trenches 28 discussed above.

Figure 2F:
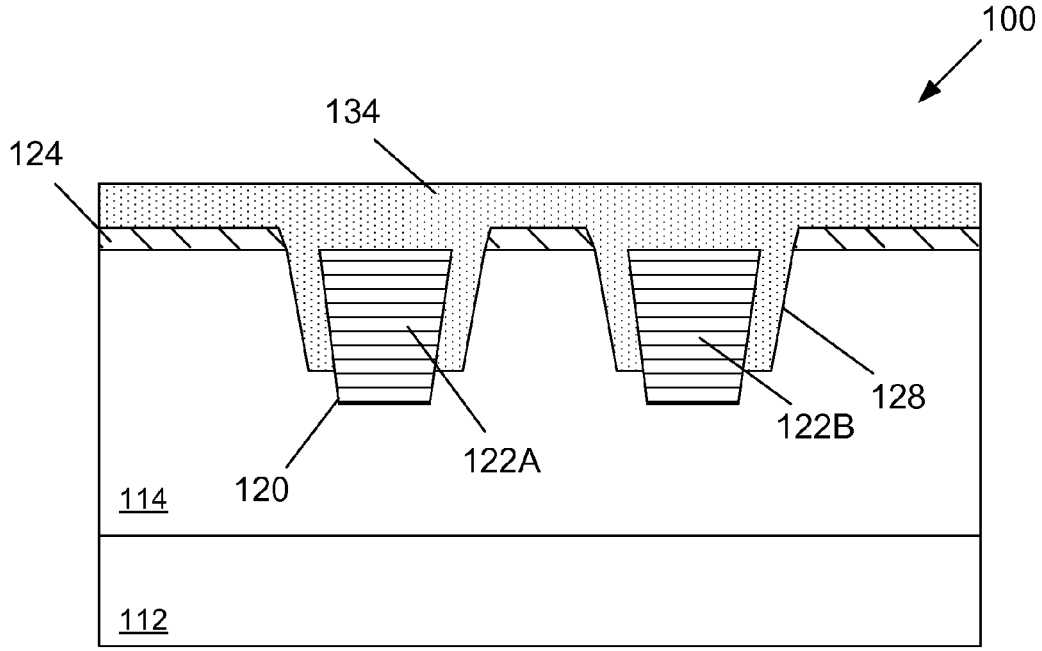

FIG. 2F depicts the product 100 after a layer of conductive metal material 134 was deposited so as to overfill the trenches 128. The conductive metal material layer 134 may be comprised of a variety of different metals or metal compounds, e.g., copper, Cu—Mn, Co, etc. Importantly, the conductive metal material layer 134 is comprised of a different material than that of the metal core regions 122A-B and it is generally made of a material that is more electrically conductive than the material of the metal core regions 122A-B.

Figure 2G:
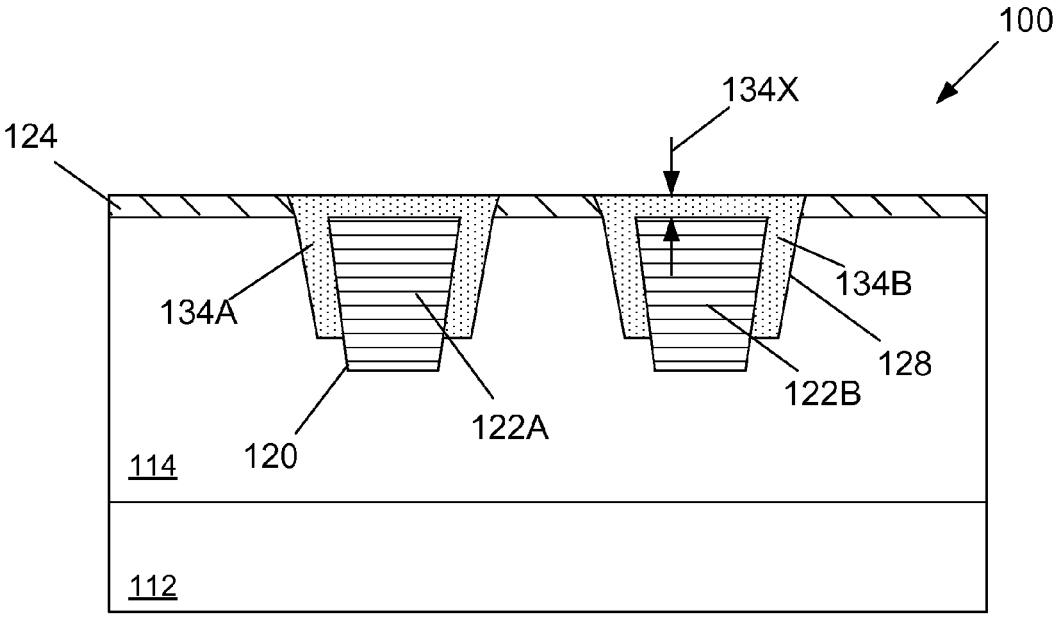

FIG. 2G depicts the product 100 after one or more planarization processes, e.g., chemical mechanical polishing (CMP) processes, were performed to remove the excess portions of the conductive metal material layer 134. This process operation results in the definition of lower metal cap layers 134A-B that are positioned around portions of the lower metal core regions 122A-B. The metal cap layers 134A-B have a thickness 134X that can vary depending upon the application, e.g., in one example, the thickness 134X may fall within the range of about 200 nm.

Figure 2H:
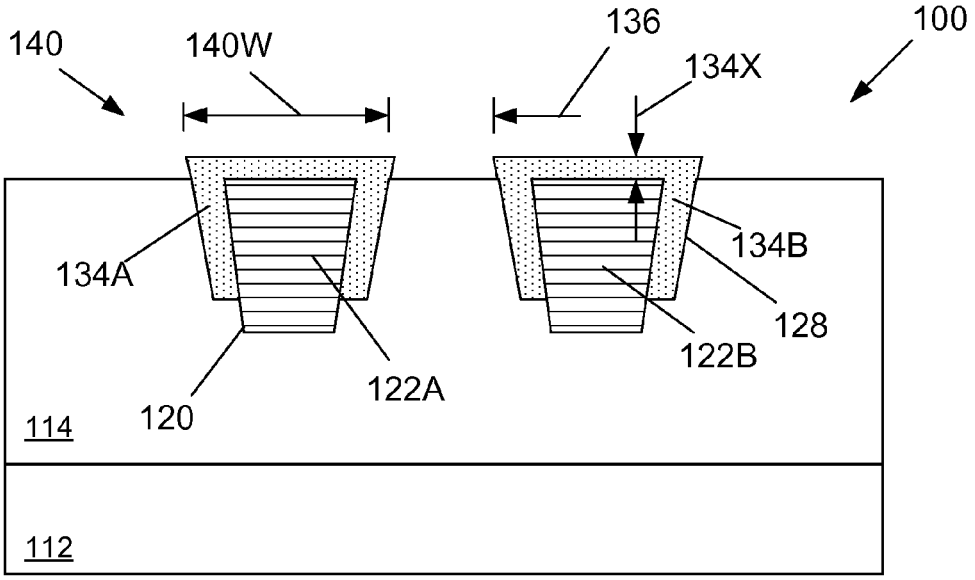

FIG. 2H depicts the product 100 after an etching process was performed to remove the patterned hard mask layer 124 relative to the surrounding structures and materials. This process completes the formation of a plurality of lower inductor/transformer structures 140, each of which is comprised of one of the metal core regions 122A-B and one of the metal cap layers 134A-B. The overall width 140W of each of the lower inductor/transformer structures 140, as well as the lateral spacing 136 between the inductor/transformer structures 140 (when multiple structures 40 are present) may vary depending upon the application, and in one embodiment may be about the same as those discussed above for the lower inductor/transformer structures 40.

Figure 2I:
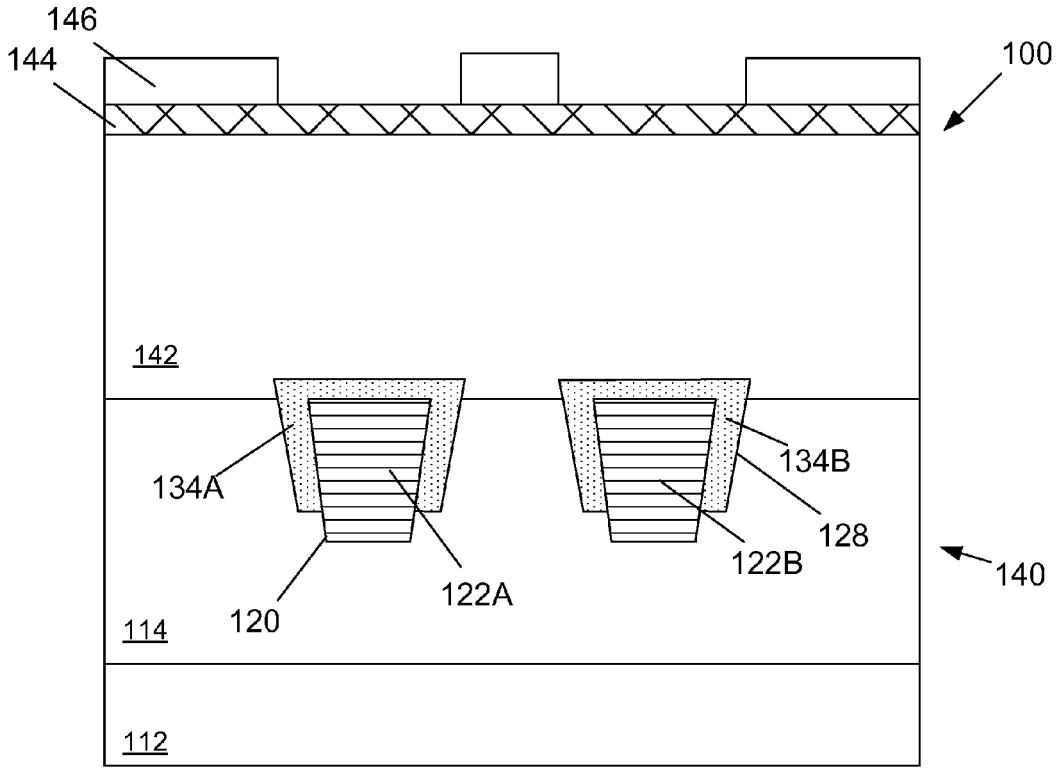

FIG. 2I depicts the product 100 after several process operations were performed. First, another layer of insulating material 142, e.g., silicon dioxide, another hard mask layer 144, e.g., silicon nitride, and another patterned photoresist mask 146 was formed above the lower inductor/transformer structures 140. The layers of insulating material 114, 142 may be made of the same material or they may be made of different materials.

Figure 2J:
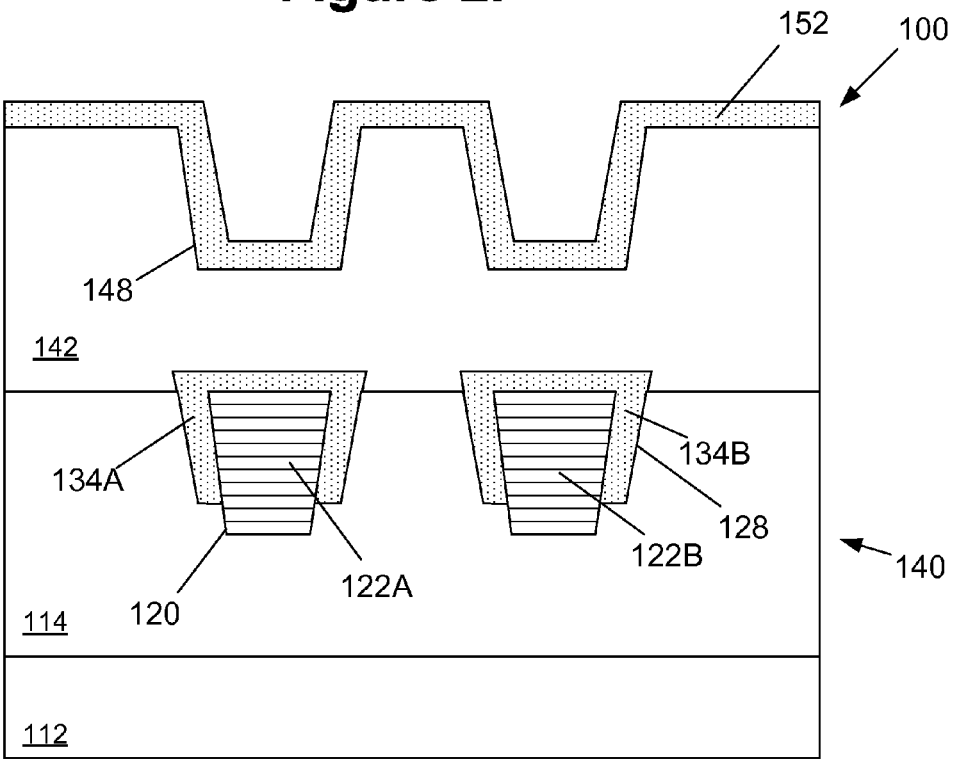

FIG. 2J depicts the product 100 after several process operations were performed. First, the hard mask layer 144 was patterned by performing an etching process through the patterned photoresist mask 146. Thereafter, the patterned photoresist mask 146 was removed, e.g., by ashing. Next, using the patterned hard mask layer 144 as an etch mask, an etching process was performed to define a plurality of trenches 148 in the layer of insulating material 142. The width and depth of the trenches 148 may vary depending upon the particular application, and in one embodiment the width and depth of the trenches 148 may generally correspond to those of the trenches 48 discussed above. The trenches 148 are essentially formed above the lower inductor/transformer structures 140. Next, the patterned hard mask layer 144 was removed by performing a selective etching process. Thereafter, a layer of conductive metal material 152 was deposited in the trenches 148 by performing a conformal deposition process. The thickness and material of the conformal conductive metal material layer 152 may vary depending upon the particular application and, in one embodiment, may generally correspond to those described above for the metal layer 52. The conductive metal materials 134, 152 may be comprised of the same or different metal materials. In one illustrative example, the conductive metal materials 134, 152 are both comprised of copper.

Figure 2K:
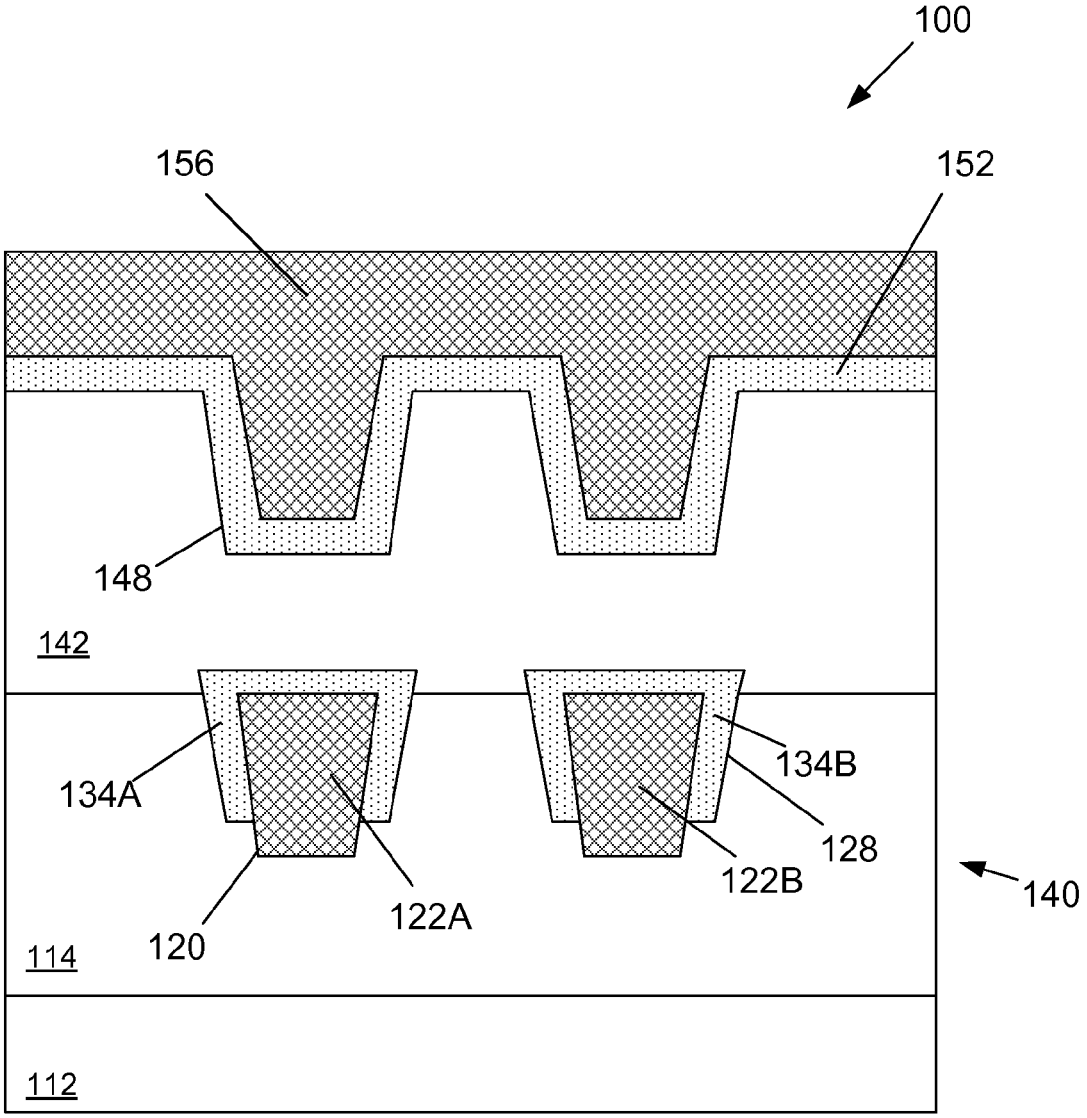

FIG. 2K depicts the product 100 after a layer of conductive metal material 156 was deposited so as to overfill the trenches 148. The conductive metal material layer 156 may be comprised of a variety of different metals or metal compounds, such as those described above for the layer of conductive material 134. Importantly, the conductive metal material layer 156 is comprised of a different material than that of the layer of conductive metal material 152 and it is generally made of a material that is less electrically conductive than the material of the layer of conductive metal material 152.

Figure 2L:
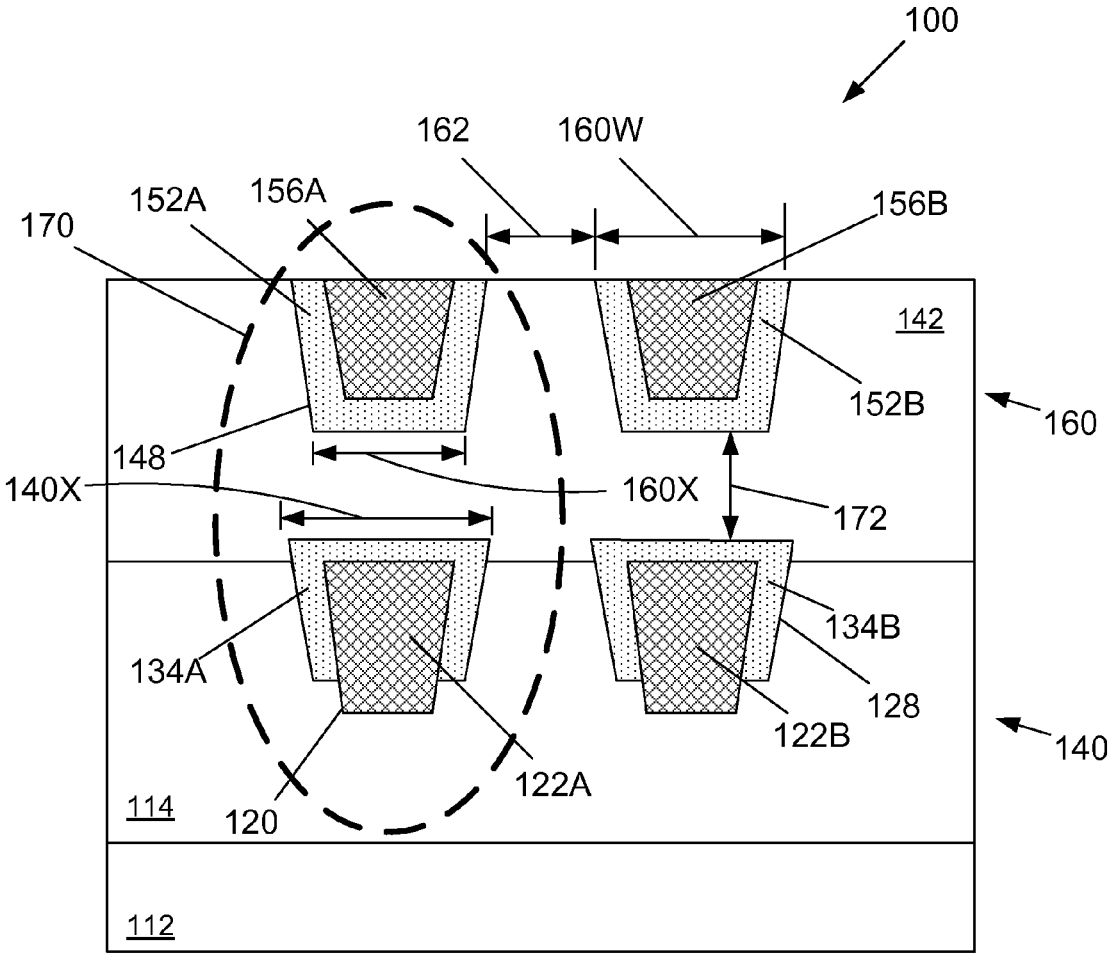

FIG. 2L depicts the product 100 after one or more planarization processes, e.g., chemical mechanical polishing (CMP) processes, were performed to remove the excess portions of the conductive metal material 156 and the layer of conductive metal material 152. These process operations result in the definition of a plurality of upper inductor/transformer structures 160, each of which is comprised of one of the metal core regions 156A-B and one of the metal cap layers 152A-B. The overall width 160W and the lower surface area of each of the upper inductor/transformer structures 160, as well as the lateral spacing 162 between the upper inductor/transformer structures 160 (when multiple structures 160 are present) may vary depending upon the application. In one illustrative embodiment, the width 160W (and the lower surface area of the upper inductor/transformer structures 160) and the lateral spacing 62 may generally correspond to the width 140W (and the upper surface area of the lower inductor/transformer structures 140) and the lateral spacing 136 between the lower inductor/transformer structures 140, although that need not be the case in each application. As noted above, the lower surface area of the upper inductor/transformer structures 160 and the upper surface area of the lower inductor/transformer structures 140 may be different from one another, i.e., one surface area may be larger or smaller than the other surface area, or they both may be about the same, depending upon the particular application.

With continuing reference to FIG. 2L, one illustrative embodiment of a novel high performance inductor/transformer structure 170 (enclosed in a dashed line) may be comprised of one of the upper inductor/transformer structures 160 and one of the lower inductor/transformer structures 140. In other embodiments, the novel high performance inductor/transformer structure 170 may include both of the upper inductor/transformer structures 160 and both of the lower inductor/transformer structures 140 so as to enhance performance. The inductor/transformer structure 170 will exhibit many of the benefits and characteristics as that described above for the inductor/transformer structure 70.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An inductor/transformer structure positioned above a semiconductor substrate, comprising:

a lower inductor/transformer structure comprising a first inner core material and a first outer cap layer, said first outer cap layer defining an upper surface area of said lower inductor/transformer structure;

an upper inductor/transformer structure positioned above and vertically spaced apart from said lower inductor/ transformer structure, said upper inductor/transformer structure comprising a second inner core material and a second outer cap layer, said second outer cap layer defining a lower surface area of said upper inductor/transformer structure, wherein said lower surface area of said upper inductor/transformer structure is different than said upper surface area of said lower inductor/transformer structure; and an insulating material positioned above an upper surface of said substrate and between said upper surface area of said lower inductor/transformer structure and said lower surface area of said upper inductor/transformer structure.

2. The inductor/transformer structure of claim 1, wherein said upper surface area of said lower inductor/transformer structure has a first lateral width and said lower surface area of said upper inductor/transformer structure has a second lateral width that is different from said first lateral width.

3. The inductor/transformer structure of claim 1, wherein said lower surface area of said upper inductor/transformer structure is larger than said upper surface area of said lower inductor/transformer structure.

4. The inductor/transformer structure of claim 1, wherein said lower surface area of said upper inductor/transformer structure is smaller than said upper surface area of said lower inductor/transformer structure.

5. The inductor/transformer structure of claim 1, wherein a vertical spacing between said lower surface area of said upper inductor/transformer structure and said upper surface area of said lower inductor/transformer structure falls within a range of about 350-800 nm.

6. The inductor/transformer structure of claim 1, wherein said first and second inner core materials are made of a magnetic material and said first and second outer cap layers are made of a conductive metal material.

7. The inductor/transformer structure of claim 6, wherein said first and second inner core materials are made of different magnetic materials and said first and second outer cap layers are made of different conductive metal materials.

8. The inductor/transformer structure of claim 1, wherein said first and second inner core materials are made of a first conductive metal and said first and second outer cap layers are made of a second conductive metal material, wherein said second conductive metal material is more electrically conductive than said first conductive metal material.

9. The inductor/transformer structure of claim 8, wherein said first and second inner core materials are made of different first conductive metals and said first and second outer cap layers are made of different second conductive metal materials.

10. The inductor/transformer structure of claim 6, wherein said magnetic material is an iron-containing magnetic material.

11. The inductor/transformer structure of claim 6, wherein said magnetic material is a non iron-containing magnetic material.

12. The inductor/transformer structure of claim 10, wherein said magnetic material is one of NiFe, CoFe, $Fe_3O_4$, or $Fe_3Al_2Si_3O_{12}$.

13. The inductor/transformer structure of claim 11, wherein said magnetic material is one of $Mn_3Al_2Si_3O_{12}$, $Ca_3Cr_2Si_3O_{12}$, $Ca_3Al_2Si_3O_{12}$, Or $Mg_3Al_2Si_3O_{12}$.

14. The inductor/transformer structure of claim 1, wherein said first and second outer cap layers comprise at least one of copper, Al, Au or Ag.

15. An inductor/transformer structure positioned above a semiconductor substrate, comprising:

a lower inductor/transformer structure comprising a first inner core material and a first outer cap layer, said first outer cap layer defining an upper surface area of said lower inductor/transformer structure;

an upper inductor/transformer structure positioned above and vertically spaced apart from said lower inductor/transformer structure, said upper inductor/transformer structure comprising a second inner core material and a second outer cap layer, said second outer cap layer defining a lower surface area of said upper inductor/transformer structure, wherein:

said lower surface area of said upper inductor/transformer structure is different than said upper surface area of said lower inductor/transformer structure;

said upper surface of said lower inductor/transformer structure has a first lateral width and said lower surface of said upper inductor/transformer structure has a second lateral width that is different from said first lateral width;

said first and second inner core materials are made of the same material; and said first and second outer cap layers are made of the same conductive metal material; and an insulating material positioned above an upper surface of said substrate and between said upper surface area of said lower inductor/transformer structure and said lower surface area of said upper inductor/transformer structure.

16. The inductor/transformer structure of claim 15, wherein said lower surface area of said upper inductor/transformer structure is larger than said upper surface area of said lower inductor/transformer structure.

17. The inductor/transformer structure of claim 15, wherein said lower surface area of said upper inductor/transformer structure is smaller than said upper surface area of said lower inductor/transformer structure.

18. The inductor/transformer structure of claim 15, wherein a vertical spacing between said lower surface area of said upper inductor/transformer structure and said upper surface area of said lower inductor/transformer structure falls within a range of about 350-800 nm.

19. The inductor/transformer structure of claim 15, wherein said first and second inner core materials are both made of a same magnetic material.

20. The inductor/transformer structure of claim 15, wherein said first and second inner core materials are both made of a same first conductive metal and said first and second outer cap layers are made of a same second conductive metal material, wherein said second conductive metal material is more electrically conductive than said first conductive metal material.

21. The inductor/transformer structure of claim 19, wherein said same magnetic material is an iron-containing magnetic material.

22. The inductor/transformer structure of claim 19, wherein said same magnetic material is a non iron-containing magnetic material.

* * * * *